US007631985B1

(12) United States Patent
Knoble et al.

(10) Patent No.: US 7,631,985 B1
(45) Date of Patent: Dec. 15, 2009

(54) FINITE ELEMENT AND MULTI-DISTRIBUTION LED LUMINAIRE

(75) Inventors: David W. Knoble, Tupelo, MS (US); George V. Preston, Belden, MS (US)

(73) Assignee: Genlyte Thomas Group, LLC, Burlington, MA (US)

( * ) Notice: Subject to any disclaimer, the term of this patent is extended or adjusted under 35 U.S.C. 154(b) by 0 days.

(21) Appl. No.: 11/119,999

(22) Filed: May 2, 2005

(51) Int. Cl.
*F21S 4/001* (2006.01)

(52) U.S. Cl. ..... 362/225; 362/240; 362/249; 362/251; 362/250; 362/545

(58) Field of Classification Search ..... 362/225, 362/240, 249, 251, 252, 545, 800
See application file for complete search history.

(56) References Cited

U.S. PATENT DOCUMENTS

| | | | | |
|---|---|---|---|---|
| 2,069,816 | A | 2/1937 | Child | |
| 4,025,777 | A | 5/1977 | Hayakawa | |
| 4,471,415 | A | 9/1984 | Larson et al. | |
| 4,654,629 | A | 3/1987 | Bezos et al. | |
| 4,667,277 | A | 5/1987 | Hanchar | |
| 4,839,781 | A | 6/1989 | Barnes et al. | |
| 4,884,178 | A | 11/1989 | Roberts | |
| 4,987,523 | A | 1/1991 | Lindabury et al. | |
| 4,999,755 | A | 3/1991 | Lin | |
| 5,084,804 | A | 1/1992 | Schairer | |
| 5,087,212 | A * | 2/1992 | Hanami | 439/620.04 |
| 5,343,375 | A | 8/1994 | Gross et al. | |
| 5,410,453 | A | 4/1995 | Ruskouski | |
| 5,580,163 | A | 12/1996 | Johnson, II | |
| 5,752,766 | A | 5/1998 | Bailey et al. | |
| 5,833,355 | A * | 11/1998 | You et al. | 362/244 |
| 5,921,670 | A | 7/1999 | Schumacher et al. | |
| 6,250,774 | B1 * | 6/2001 | Begemann et al. | 362/231 |
| 6,357,893 | B1 | 3/2002 | Belliveau | |
| 6,379,026 | B1 | 4/2002 | Petrick | |
| 6,428,183 | B1 | 8/2002 | McAlpin | |
| 6,450,663 | B1 * | 9/2002 | Reinbach | 362/249 |
| 2002/0018342 | A1 | 2/2002 | Shemitz et al. | |
| 2002/0105807 | A1 | 8/2002 | Loughrey | |
| 2002/0114155 | A1 | 8/2002 | Katogi et al. | |
| 2002/0136009 | A1 | 9/2002 | Yoneda | |
| 2002/0136010 | A1 | 9/2002 | Luk | |
| 2002/0181231 | A1 | 12/2002 | Luk | |
| 2004/0012959 | A1 * | 1/2004 | Robertson et al. | 362/247 |
| 2005/0041436 | A1 * | 2/2005 | Ishida | 362/518 |
| 2005/0063182 | A1 * | 3/2005 | Birch et al. | 362/249 |
| 2006/0087831 | A1 * | 4/2006 | Kramer | 362/101 |

* cited by examiner

*Primary Examiner*—Ricky L Mack
*Assistant Examiner*—Mark Tsidulko

(57) ABSTRACT

The instant invention is a luminaire comprised generally of mounting plate including a plurality of mounting blocks secured to said mounting plate; and a plurality of LEDs, wherein at least one of said LEDs is positioned upon each of said mounting blocks. The mounting blocks include face portions having a plurality of pitches or angles and may be arranged in a plurality of configurations on said mounting plate.

16 Claims, 9 Drawing Sheets

FINITE ELEMENT AND MULTI-DISTRIBUTION LED LUMINAIRE

BACKGROUND OF THE INVENTION

1. Field of the Invention

The present invention relates generally to an improved lighting fixture and more specifically to an improved lighting fixture having a plurality of independently adjustable light emitting diodes or LEDs to provide illumination to a plurality of lighting areas.

2. Description of the Related Art

Many lighting fixtures utilize light-emitting diodes, or LEDs. For example, U.S. Patent Pub. No. 2002/1036009A1 to Yoneda, teaches a pair of light emitting members where each member includes a plurality of LEDs disposed to form a flare shape. Cylindrical lenses are disposed where they capture light emitted from the LED members and concentrate it onto a given surface. Thus a specific area of a subject can be illuminated for inspection by adjusting the pitch of the lenses at the time of bonding them to the lens support plate to vary the light concentrated area.

U.S. Patent Pub. No. 2002/0114155A1 to Katogi et al., teaches an illumination unit comprised of a plurality of LEDs positioned on a base plate and encircled by a clear glass tube. The plurality of LEDs is placed on a single long rectangular base plate. U.S. Pat. No. 5,410,453 issued to Ruskouski, teaches a lighting device for illuminating an exit sign. The device is comprised of a plurality of light directing apertures on one side with a plurality of LEDs recessed into the apertures. The LEDs are mounted on circuit mounting means and the light from the LEDs is thence directed towards an exit sign.

With the advent of high wattage LEDs, increased efficiency, and decreased heat dissipation, it is desirable to devise a luminaire utilizing these high efficiency light sources. However, even the most powerful LEDs feasible to employ for commercial lighting use currently have only a 5-Watt maximum output, yielding approximately 150 lumens. Such an LED has an integral lens, yielding a well-defined beam pattern. Since each LED comprises a light-emitting member having a specified width, concentrating light requires a lens having a larger diameter, which is often very expensive. While the use of redesigned and modified lenses for concentrating light emitted from the LEDs is feasible, it is economically preferable to utilize existing lenses.

However, the aforementioned prior art luminaires do not provide a lighting system capable of a high degree of adjustment for illumination of a wide variety of lighting zones. A plurality of LEDs with lenses for concentrating light in a particular area may be used if desired, but the use of such lenses is expensive. LEDs which may be individually adjustable to concentrate and focus the light provided by a luminaire are desired.

SUMMARY OF THE INVENTION

In view of known deficiencies associated with earlier lighting fixtures the instant invention provides a luminaire having LEDs positioned upon individual mounting blocks, where the individual mounting blocks can be positioned in a plurality of arrangements on a support plate, and each LED can be aimed by adjusting the pitch of each individual mounting block such that the LEDs concentrate emitted light as preferred by a user. The instant invention is responsive to the desire to increase lighting efficiency via the use of LEDs, without having to incur the costs associated with expensive modified LED lenses.

The individual mounting blocks of the present invention can be arranged in a plurality of arrays or configurations depending on the illumination requirements of a given lighting application. The individual mounting blocks can have a plurality of different pitches or angles, and a plurality of different heights to yield a variety of different lighting patterns by simply configuring the mounting blocks. The luminaire thus constructed is capable of concentrating light emitted from the LEDs onto a given lighting area as preferred by the user.

Furthermore, the instant invention permits the pitch (i.e., angle) of each LED to be adjusted by mounting the LED to a mounting block having the desired pitch. The LEDs can then be aimed individually or as a group to concentrate the illumination to a specific portion of a room, floor, wall, or ceiling, or a perhaps a more dispersed illumination across a room, floor, wall, or ceiling.

The instant invention is comprised of a plurality of LED housings arranged on individual aluminum formed portions, or mounting blocks, secured to a mounting plate of a luminaire. An LED is positioned within each LED housing. The LED housings are thence positioned on the mounting blocks and can be grouped and aimed to concentrate emitted light to illuminate an egress path on the floor or a portion of a ceiling, or to disperse emitted light across a floor, ceiling, or wall. Each LED housing can be individually aimed so that a portion of the floor, ceiling, or wall is illuminated by one or several LEDs.

The aiming of the LEDs in the luminaire is accomplished by adjustment of the individual mounting blocks of the luminaire, upon which individual LEDs are mounted. The mounting blocks include faces angled at varying pitches so as to aim each individual LED in a preferred direction. Also, mounting blocks can be a different height. The cumulative effect of a plurality of properly aimed LEDs is to yield a luminaire which gives a specifically desired illumination.

Additionally, the plurality of mounting blocks may be positioned on the mounting plate in specified arrays and configurations to direct light in a particular area or areas, and to yield a desired illumination pattern. For example, a symmetrically-arranged luminaire yields wide spacing-to-mounting ratios and even floor illumination. Also, for example, to evenly illuminate a ceiling, the indirect luminaire will be positioned suspended a short length from the ceiling and the individual LEDs directed outwardly to direct light to a wide area of the ceiling being illuminated. As another example to illuminate a narrow portion of the floor, LEDs may be individually aimed so that their cumulative effect is to yield a focused and concentrated illumination.

For a better understanding of the present invention together with other and further objects thereof, reference is made to the following detailed description of the preferred embodiments, taken in conjunction with the accompanying drawing Figures and the claims appended hereto.

BRIEF DESCRIPTION OF THE DRAWINGS

The aspects and advantages of the present invention will be better understood when the detailed description of the preferred embodiment is taken in conjunction with the accompanying drawings, in which.

DETAILED DESCRIPTION OF THE PREFERRED EMBODIMENTS

Figure 1:
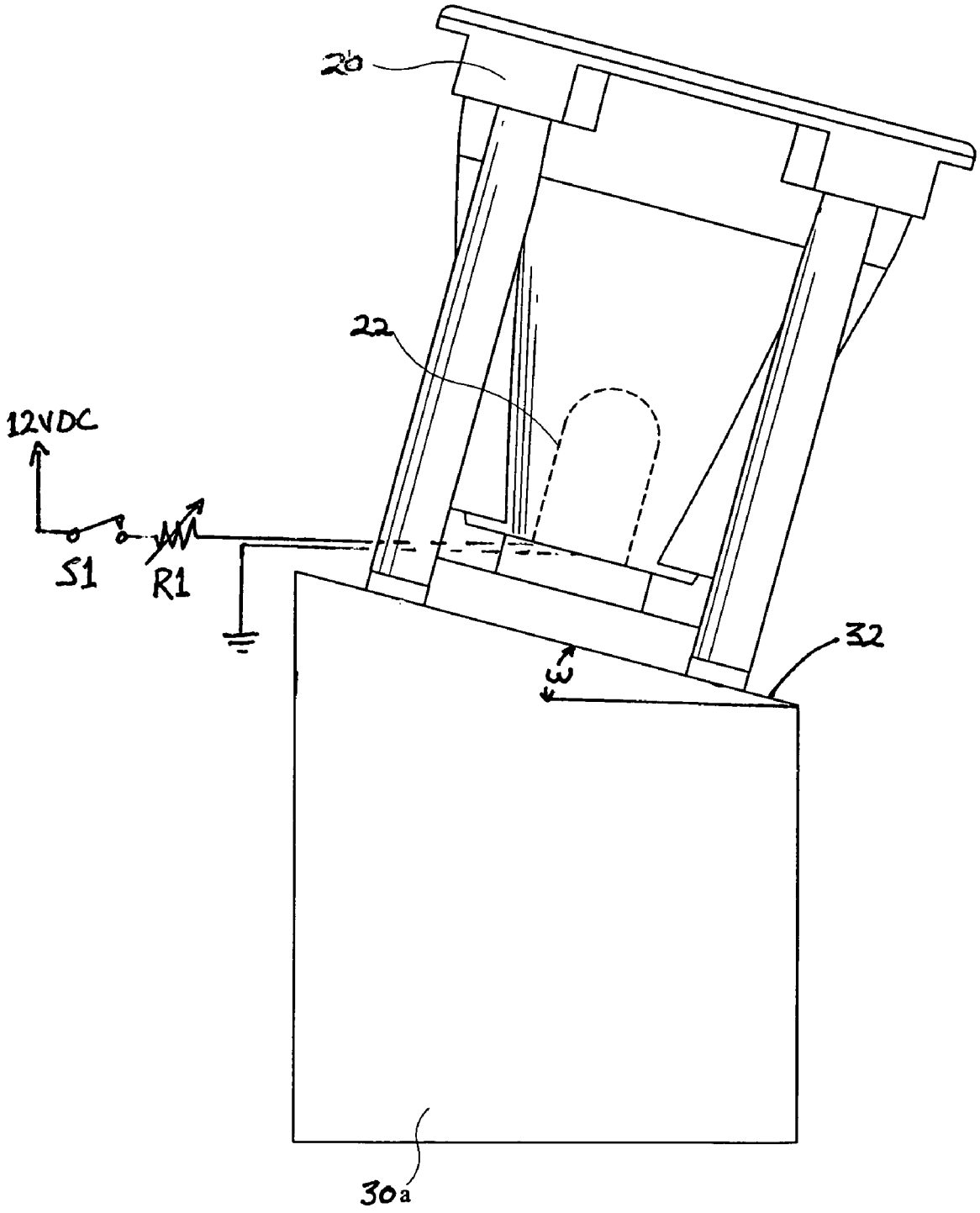
FIG. 1 is a side view of a single mounting block and LED housing.

While this invention is susceptible of embodiments in many different forms, there are shown in the Figures and will herein be described in detail, preferred embodiments of the invention with the understanding that the present disclosure is to be considered as an exemplification of the principles of the invention, and is not intended to limit the broad aspects of the invention to the embodiments illustrated.

Referring now to the drawing FIGS. 1-4, the present invention provides a luminaire 1 or lighting fixture generally comprised of a housing 10 that may be plurality of shapes, depending upon the luminaire. A mounting plate 14 is secured within luminaire 1 housing 10. While mounting plate 14 as shown is generally planar and rectangular in shape, one of ordinary skill in the art will appreciate that mounting plate 10 may be produced in a wide variety of shapes to accommodate a particular luminaire 1 shape.

Figure 3:
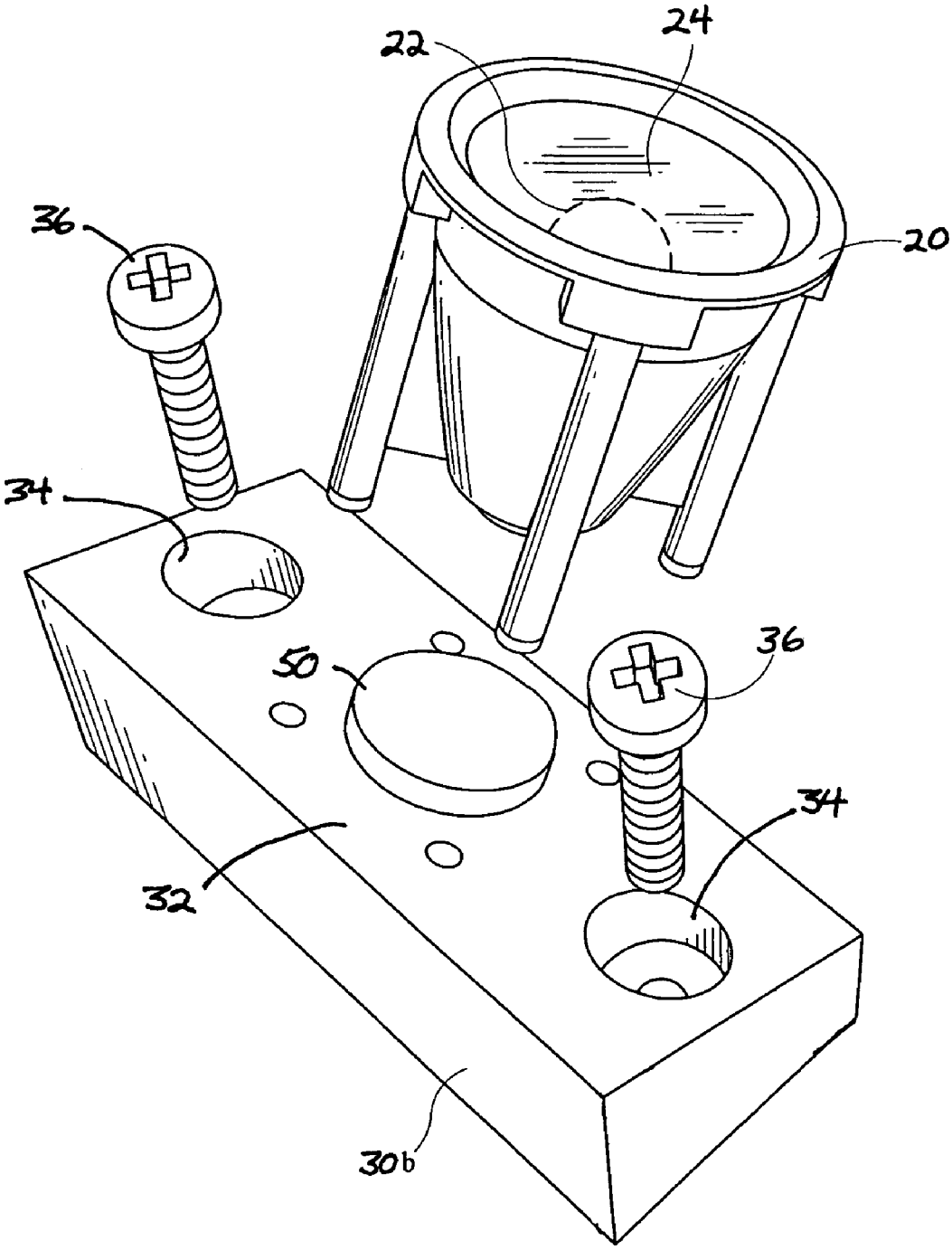
FIG. 3 is an exploded perspective view of a single LED housing and a mounting block.
Figure 4:
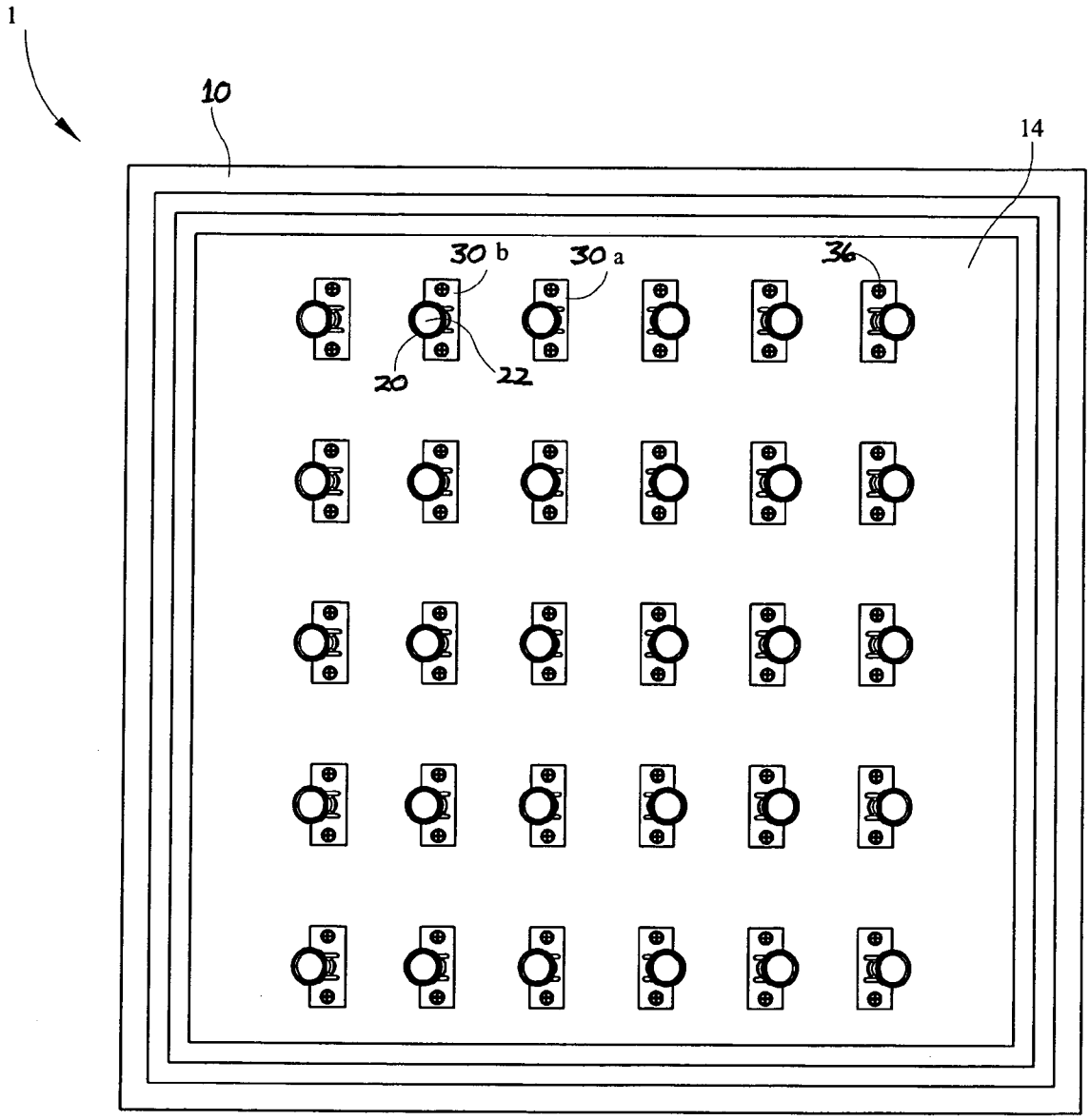
FIG. 4 is a plan view of a luminaire with LED housings arranged on mounting blocks in a matrix array.

A light emitting diode (i.e., LED) housing 20 includes an LED 22 which is connected to a suitable power source (not shown), for example a DC power supply and concomitant wiring. The housing 20 may further include a lens 24 for focusing light emitted from LED 22. A plurality of mounting blocks 30*a* and 30*b*, each having a face portion 32 are secured at various locations to mounting plate 14. As shown in FIG. 3, the mounting blocks 30*a,b* may include at least one aperture 34 that accepts a conventional fastener 36 to secure mounting blocks 30*a,b* to mounting plate 14. The face portion 32 of mounting blocks 30 may be positioned at an angle relative to mounting plate 14 to define the angle of light emission from LEDs 22, as will be discussed further herein below.

Figure 2:
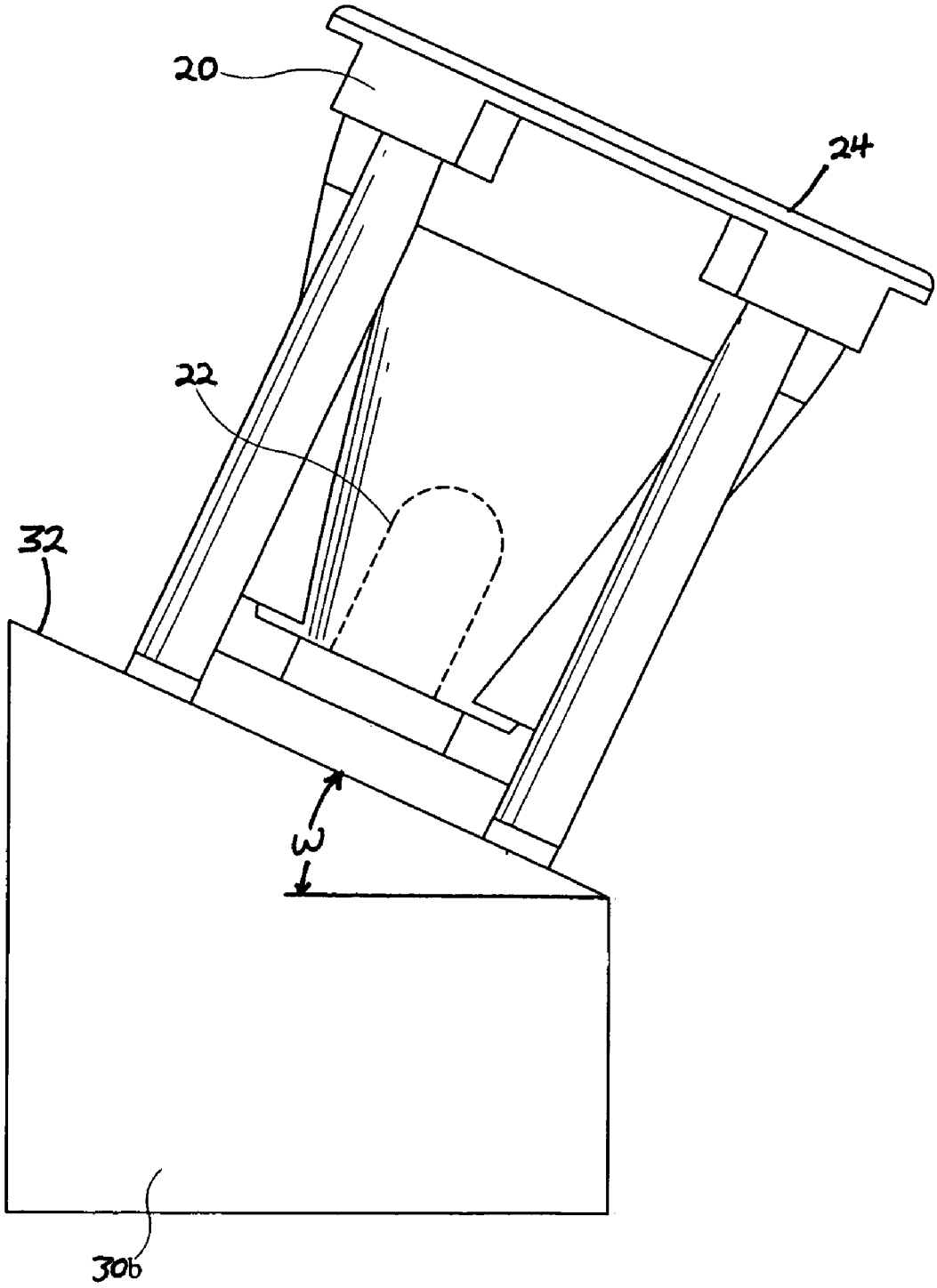
FIG. 2 is an alternative mounting and LED housing.

As best viewed in FIGS. 1 and 2, the face portion 32 of each mounting block 30*a,b* has a predetermined angle w relative to mounting plate 14 that varies depending upon the height of sides a and b of mounting blocks 30*a,b*. A luminaire 1 may include a plurality of mounting blocks 30*a,b* having various face portion 32 angles w, for directing light to a plurality of lighting zones or areas. The configuration and array of mounting blocks 30 on mounting plate 13 shown in FIGS. 5-8 are exemplary of the plurality of configurations and arrays that are made possible by the instant invention.

Referring again to FIGS. 1 and 2, LED housing 20 is mounted on face portion 32 of mounting blocks 30*a,b*, which are in turn secured at various locations to mounting plate 14. While many different types of light emitting devices may be employed with the system of the present invention, for example incandescent bulbs or the like, LEDs 22 may be advantageously employed since they have a long service lifetime, are efficient light emitters, and require a relatively small amount of electrical energy, which distinguishes them from other types of known in the art lamps. By securing LED housing 20 to angled face portion 32 of mounting blocks 30*a,b*, the LED 22 is disposed at an angle relative to mounting plate 14, thereby permitting light to be directionally emitted based upon the angle of face portion 32.

In one embodiment of the present invention, mounting blocks 30 further include an integral socket 50 for accepting LED housing 20, whereby the socket 50 electrically connects LED 22 to a power source. In this embodiment of the present invention, power wiring (not shown) is routed to each individual mounting block 30 and socket 50 so that an LED housing 20 may be readily replaced if defective, or if an LED having a different intensity is desired for a given lighting application. This feature of the present invention permits a user to quickly and efficiently customize a luminaire 1 for a wide variety of lighting applications. In an alternative embodiment of the present invention, an adhesive, for example a thermally conductive adhesive, may be used to secure the LED housing 20 directly to mounting block 30 without the necessity of using a socket 50.

Furthermore, the present invention provides a system that permits a user to individually adjust and aim LEDs 22 by utilizing a plurality of mounting blocks 30 having different pitches w for face portions 32, and different overall heights a. As seen in FIGS. 1, 2, 6, and 8, mounting blocks 30 may have a variety of different heights a and face portion 32 angles w, to effect a desired illumination distribution. Mounting blocks 30*a,b* having larger angles w may be positioned, in one example, towards the perimeter of mounting plate 14 whereby light emitted from LEDs 22 mounted thereon would be aimed further outwardly from the luminaire 1 than those LEDs 22 mounted towards the center of mounting plate 14.

Figure 5:
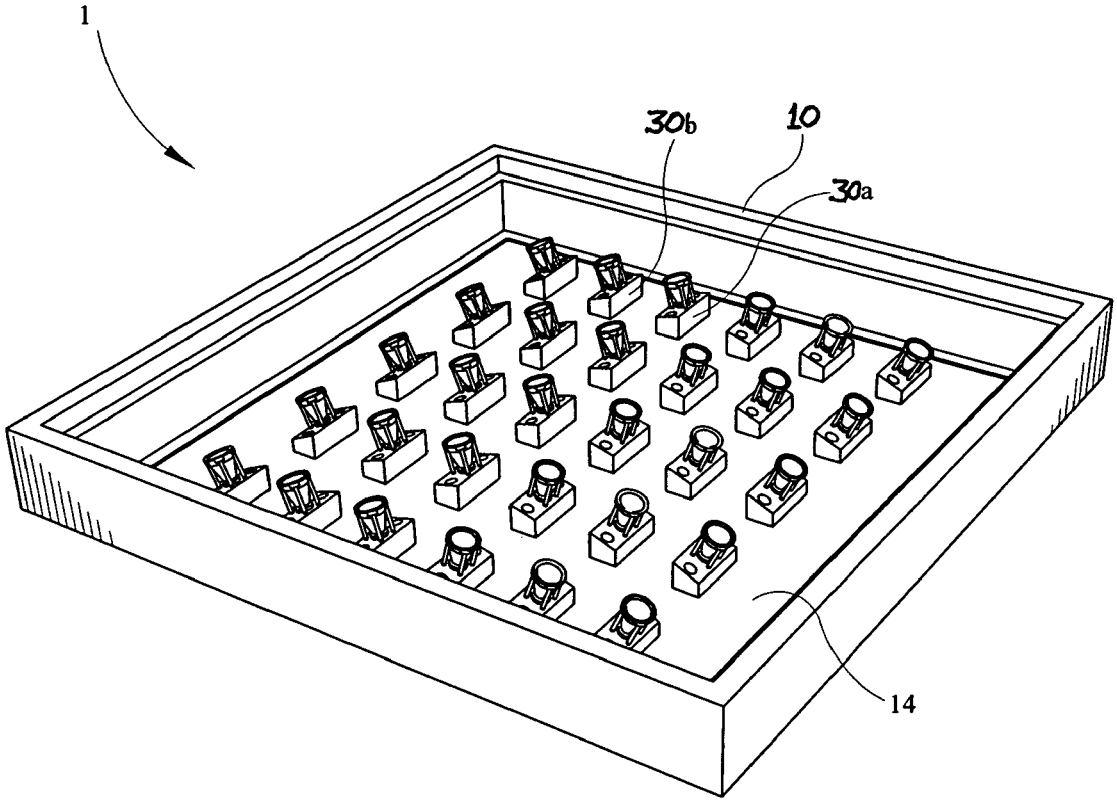
FIG. 5 is a perspective view of a luminaire with LED housings arranged on mounting blocks in the same array as in FIG. 4.
Figure 6:
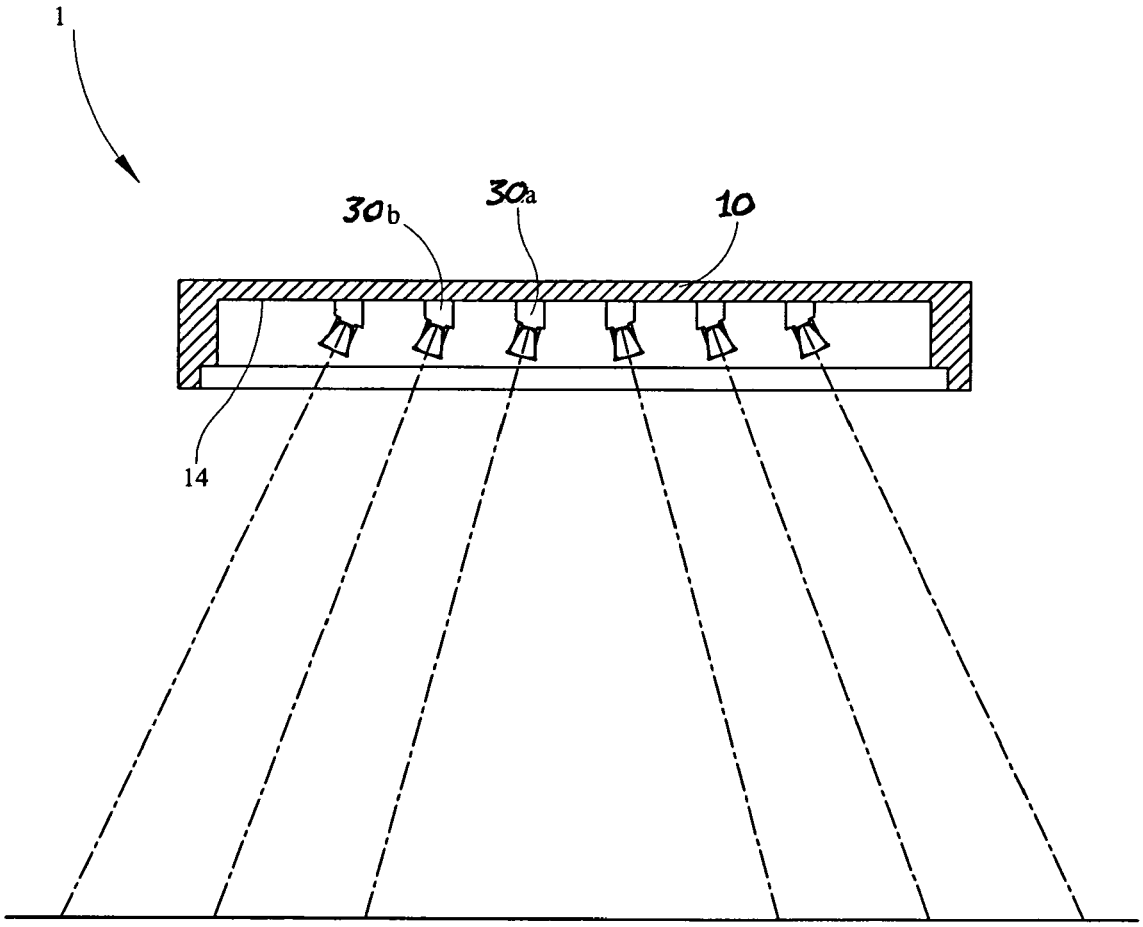
FIG. 6 is a plan view of the luminaire having the mounting block array of FIG. 5.
Figure 7:
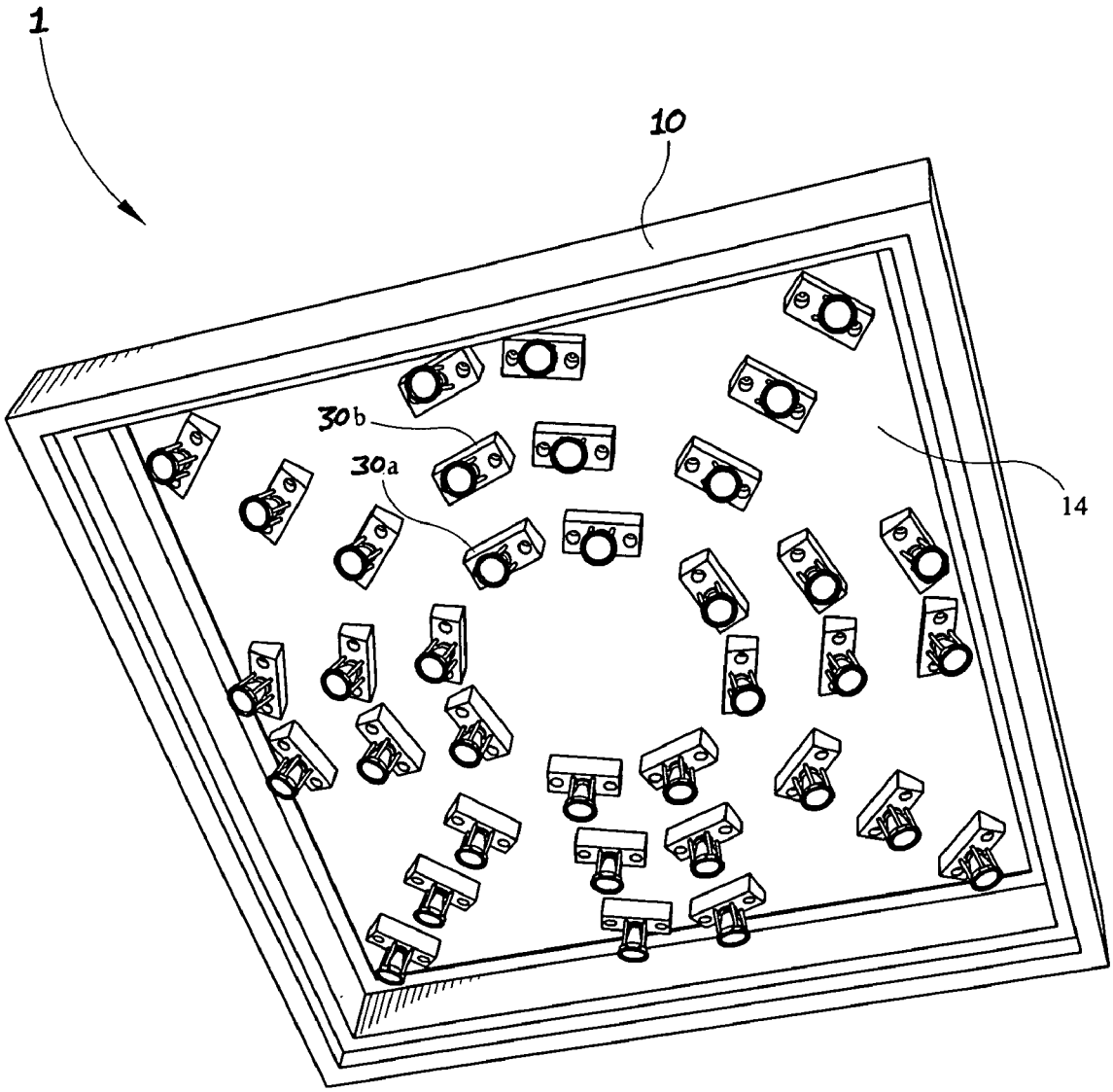
FIG. 7 is a perspective view of a luminaire with LEDs arranged on mounting blocks in a circular array.
Figure 8:
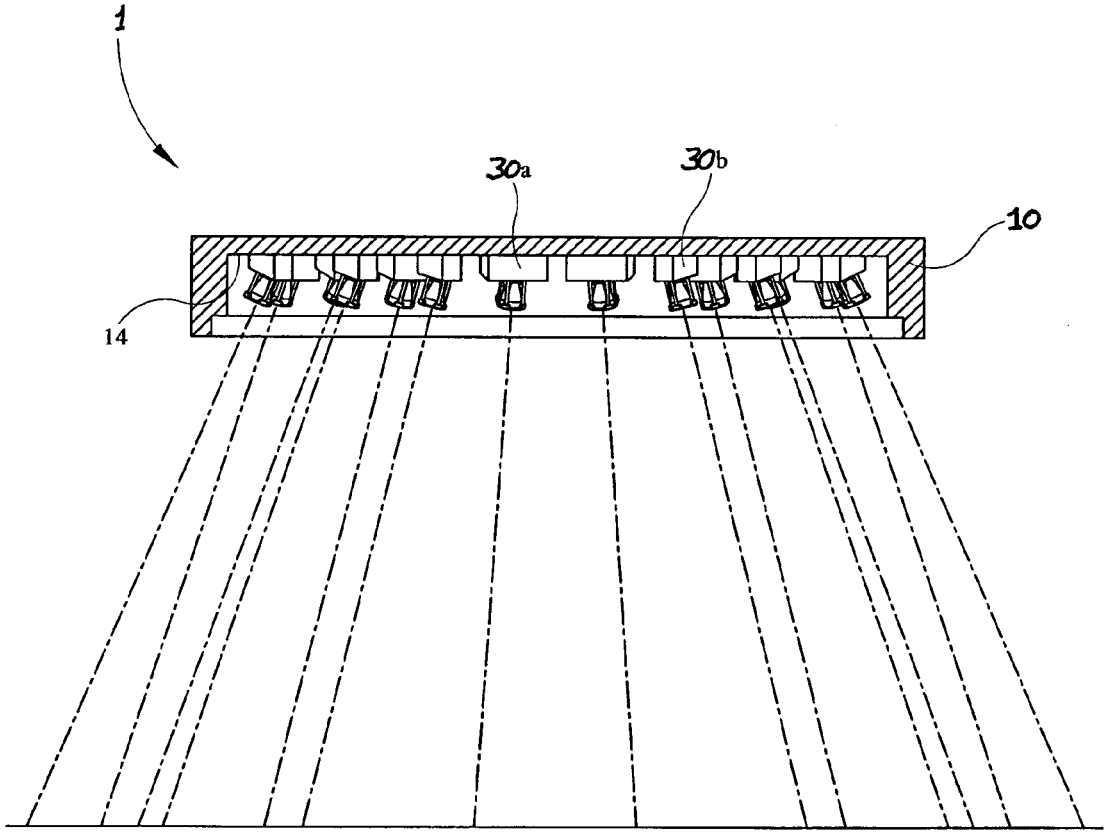
FIG. 8 is a plan view of the luminaire having the mounting block array of FIG. 7.

As can be seen from the exemplary embodiments shown in FIGS. 5 and 7, mounting blocks 30 and concomitant LED housings 20 may be positioned in an infinite variety of arrays and configurations on mounting plate 14. FIG. 7 depicts an array of mounting blocks 30 and LEDs 22 forming concentric circles on mounting plate 14. FIG. 5 depicts a five by six matrix array of mounting blocks 30 and LEDs 22. Accordingly, it is readily seen that by varying the placement, the face portion 32 angle w, and the height of mounting blocks 30, an single luminaire can be customized to provide illumination for an enormous number of lighting design applications.

In a yet further embodiment of the invention as depicted in FIG. 1, individual LEDs 22 may be equipped with a rheostat R1 or equivalent dimmer switch, and/or an on/off switch S1 to permit the LED 22 to either operate at lower power and thus reduced luminosity, or be turned off entirely. Furthermore, a bank or plurality of LEDs 22 may be so equipped such that the entire bank may be dimmed or powered off simultaneously. This feature of the present invention permits further customization of a luminaire 1 without requiring a user to replace LEDs 22 or reconfigure mounting blocks 30. For example, in the luminaire 1 of FIG. 5, an entire concentric circle of LEDs 22 may be controlled through rheostat R1 and/or switch S1 to vary the overall light intensity emitted thereby. Accordingly, it will be recognized that a plurality of rheostats R1 and switches S1 may be employed to dim or turn off a plurality of LEDs 22 as required by a user.

Figure 9:
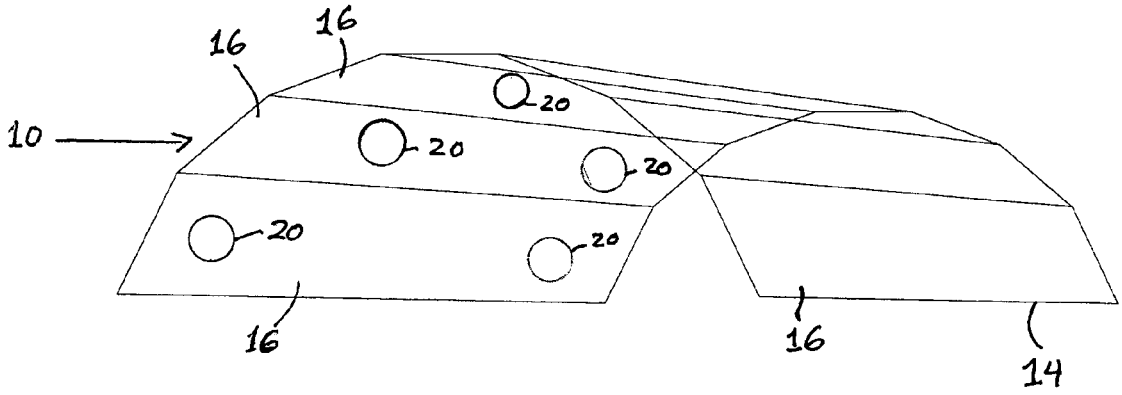
FIG. 9 is an isometric view of one embodiment of the mounting plate of the present invention.
Figure 10:
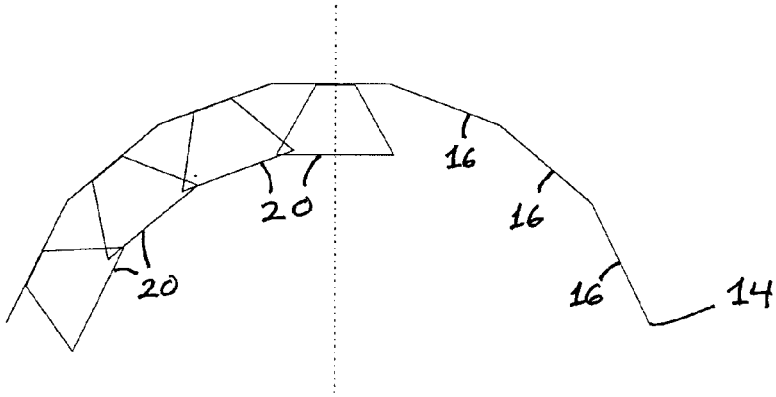
FIG. 10 is a view of the mounting plate taken along the line 10 of FIG. 9.

Referring now to FIGS. 9 and 10, and in accordance with an alternative embodiment of the present invention, mounting plate 14 may comprise a plurality of oriented surfaces 16 to which are secured a plurality of LED housings 20, at various locations. This embodiment of the present invention provides for orientation of LED 22 light emission by simply mounting the housing 20 on the mounting plate 14 surfaces 16, thereby obviating the need for mounting blocks to accomplish the orientation. This embodiment of the invention permits a wide variety of mounting plate 14 oriented surface 16 designs, depending upon the lighting requirements of the application. For example, a plurality of oriented surfaces 16 may conform to a generally curved surface shape of mounting plate 14, or may be angled to provide a mounting location for LEDs such that a particular lighting area is illuminated. LED housings 20 may be spaced along the oriented surfaces 16, or clustered proximate each other as necessary.

Although the present invention has been described in terms of the preferred embodiments thereof, it will be obvious to a person skilled in the art that various alterations and modifications to the instant invention are possible without departing from the scope thereof, set forth in the appended claims.

What is claimed is:

1. A luminaire for providing illumination to a plurality of lighting areas comprising:

a mounting plate having a plurality of mounting blocks releasably secured thereto whereby said mounting blocks may be re-oriented to illuminate a one of said lighting areas, each mounting block having a mounting face thereon positioned at a predetermined angle relative to said mounting plate; and a plurality of light emitting diodes positioned on the mounting faces of the plurality of mounting blocks, whereby each light emitting diode is positioned at a predetermined angle relative to said mounting plate;

wherein the mounting blocks have mounting faces thereon having a plurality of predetermined angles relative to said mounting plate.

2. A luminaire as claimed in claim 1, wherein the plurality of mounting blocks are secured to said mounting plate in a patterned array to illuminate a plurality of lighting areas.

3. A luminaire as claimed in claim 2 wherein the patterned array is a plurality of concentric circles.

4. A luminaire as claimed in claim 2 wherein the patterned array is a matrix of predetermined size.

5. A luminaire as claimed in claim 1 wherein the mounting blocks are interchangeable.

6. A luminaire as claimed in claim 1 wherein the plurality of mounting blocks have a plurality of different heights.

7. A luminaire as claimed in claim 1 wherein said mounting plate further comprises a plurality of orienting surfaces to which said mounting blocks are secured.

8. A luminaire as claimed in claim 1 further comprising:

a rheostat for varying a source of electrical power supplied to at least one of said LEDs, whereby the illumination provided by said at least one LED may be varied.

9. A luminaire as claimed in claim 8 further comprising:

a switch for removing the source of electrical power supplied to at least one of said LEDs.

10. A luminaire for providing illumination to a plurality of lighting areas comprising:

a mounting plate having a plurality of mounting blocks releasably secured thereto whereby said mounting blocks may be re-oriented to illuminate a one of said lighting areas, each mounting block having a mounting face positioned at a predetermined angle relative to said mounting plate;

a plurality of sockets secured to the mounting faces of said mounting blocks for accepting a light emitting diode, each socket electrically connected to a power source; and a plurality of light emitting diodes disposed in said plurality of sockets, whereby each light emitting diode is positioned at a predetermined angle relative to said mounting plate;

wherein the mounting blocks have mounting faces thereon having a plurality of predetermined angles relative to said mounting plate.

11. A luminaire as claimed in claim 10, wherein the plurality of mounting blocks are secured to said mounting plate in a patterned array to illuminate a plurality of lighting areas.

12. A luminaire as claimed in claim 11 wherein the patterned array is a plurality of concentric circles.

13. A luminaire as claimed in claim 11 wherein the patterned array is a matrix of predetermined size.

14. A luminaire as claimed in claim 10 wherein the mounting blocks are interchangeable.

15. A luminaire as claimed in claim 10 wherein the plurality of mounting blocks have a plurality of different heights.

16. A luminaire as claimed in claim 10 wherein said mounting plate further comprises a plurality of orienting surfaces to which said mounting blocks are secured.

* * * * *